US005107815A

United States Patent [19]

Van Duyne

[11] Patent Number: 5,107,815

[45] Date of Patent: Apr. 28, 1992

[54] VARIABLE AIR/FUEL ENGINE CONTROL SYSTEM WITH CLOSED-LOOP CONTROL AROUND MAXIMUM EFFICIENCY AND COMBINATION OF OTTO-DIESEL THROTTLING

[75] Inventor: Edward Van Duyne, Framingham, Mass.

[73] Assignee: Massachusetts Institute of Technology, Cambridge, Mass.

[21] Appl. No.: 542,445

[22] Filed: Jun. 22, 1990

[51] Int. Cl.[5] ..... F02M 7/00

[52] U.S. Cl. ..... 123/435

[58] Field of Search ..... 123/435, 445, 480, 488, 123/489, 417; 364/431.05

[56] References Cited

U.S. PATENT DOCUMENTS

| | | | |
|---|---|---|---|
| 4,368,707 | 1/1983 | Leshner et al. | 123/436 |
| 4,608,956 | 9/1986 | Katob et al. | 123/417 |
| 4,644,921 | 2/1987 | Kobagashi et al. | 123/489 |
| 4,825,838 | 5/1989 | Osuga et al. | 123/489 |
| 4,864,989 | 9/1989 | Markley | 123/267 |
| 4,867.125 | 9/1989 | Grevemeyer | 123/489 |
| 4,870,938 | 10/1989 | Nakaniwa | 123/489 |
| 4,878,472 | 11/1989 | Hibino | 123/489 |
| 4,887,575 | 12/1989 | Takahashi | 123/435 |
| 4,908,765 | 3/1990 | Murakami et al. | 364/431.05 |
| 4,913,118 | 4/1990 | Watanaba | 123/435 |

OTHER PUBLICATIONS

The Internal-Combustion Engine in Theory and Practice by C. F. Taylor, (Che M.I.T. Press, 1968) no month provided.

The New Oil Crisis and Fuel Economy Technologies by D. L. Bleviss (Quorum Books, 1988) no month provided.

*Primary Examiner*—Raymond A. Nelli

*Attorney, Agent, or Firm*—Choate, Hall & Stewart

[57] ABSTRACT

System for controlling a spark ingnition engine to maximize fuel efficiency over its entire range of operating conditions. The system includes apparatus for controlling the amount of fuel delivered to the engine and apparatus for measuring the internal cylinder pressure in at least one cylinder of the engine. Apparatus is provided for estimating the air mass entering the engine and computing apparatus calculates the engine efficiency from the amount of fuel delivered, the internal cylinder pressure and the estimated air mass entering the engine. In one embodiment, efficiency is measured by calculation of the approximate indicated specific fuel consumption. Apparatus is provided for varying the amount of fuel delivered to the engine to minimize the indicated specific fuel consumption over the entire range of operating conditions of the engine. In this embodiment, apparatus is provided which is responsive to a desired engine power output beyond wide open throttle plate and apparatus is provided for delivering a greater quantity of fuel beyond the wide open throttle plate position maximum efficiency point.

21 Claims, 11 Drawing Sheets

| CURVE | $\theta_N$ (DEGatde) | $\theta_b$(DEG) | bmep(BAR) | imep(BAR) | $\eta/\eta$Otto |
|---|---|---|---|---|---|
| 1 | 0 | 40 | 5.0 | 6.0 | 0.73 |
| 2 | -13 | 40 | 5.7 | 7.5 | 0.82 |
| 3 | -26 | 38 | 5.8 | 7.5 | 0.82 |
| 4 | 37 | 39 | 5.0 | 6.9 | 0.74 |

Upper: KISTLER Pressure Transducer
Lower: PGS

Engine: 1800°°, 4 Cylinders
Measuring Method:

VARIABLE AIR/FUEL ENGINE CONTROL SYSTEM WITH CLOSED-LOOP CONTROL AROUND MAXIMUM EFFICIENCY AND COMBINATION OF OTTO-DIESEL THROTTLING

BACKGROUND OF THE INVENTION

This invention relates to a variable air/fuel ratio engine control system in combination with Otto-diesel throttling.

For years, automotive engineers have attempted to improve the efficiency of internal combustion automobile engines and present day engines are indeed much more efficient than earlier ones. Heretofore, the application of closed-loop computer control around maximum efficiency has been overlooked since it was thought to be too complicated or too expensive. One way to optimize total engine efficiency is to compute the output torque versus the fuel delivered and then find the point of minimum brake specific fuel consumption (BSFC). The measurement of BSFC has been done in the laboratory for years, but has never been used in a closed-loop system on a car. Although the measurement works well in a laboratory where torque can be measured with a dynamometer, real time torque measurement on a vehicle is expensive and a better alternative is to measure cylinder pressure because it provides so much information.

From measured cylinder pressure, the indicated mean effective pressure (IMEP) can be derived. This parameter is a measure of the average internal cylinder pressure that is applied to the piston to generate torque. It is an accurate torque representative except for the amount of torque lost to internal engine friction With the IMEP, it is possible to calculate the indicated specific fuel consumption (ISFC). With a measure of ISFC, it is possible to operate an engine very close to its maximum efficiency level at all times. It is also possible to estimate the brake mean effective pressure (BMEP) from the IMEP, assuming some knowledge of friction as a function of engine speed and load. This approach would allow direct control around approximate brake specific fuel consumption (BSFC) for maximum efficiency at all times.

The above approach has not been followed in the past because of emission control regulations. It is generally perceived that the three-way catalyst is the only feasible way to meet emissions regulations. A three-way catalyst, however, requires a stoichiometric air/fuel mixture to achieve the chemical reaction necessary to reduce emissions and, therefore, lean burn has been mostly ignored. So, even though it is recognized that maximum efficiency occurs at lean air/fuel ratios for most speed and load conditions of an internal combustion engine, lean burn has not been exploited because of three-way catalyst requirements. As will become clear below, with the right combination of components and accurate control of these components, a lean burn engine can be designed to pass current emissions regulations.

Some of the components to carry out the present invention have existed for only a short time. Microprocessors are now available which can calculate ISFC of BSFC in real time as well as having the capability to control the large variation in air/fuel ratio and ignition timing necessary to achieve reliable lean burn. Good fuel atomizers have been around for some time, but typically work well only in a specific flow range. High power ignitions have also been known for a long time, but have been very inefficient. As will be discussed below, maximizing combustion efficiency can be coupled with a minimization of total emissions, potentially eliminating the need for a catalyst entirely while passing present emissions standards.

In the past, lean burn control has typically been done by open-loop systems. Because such systems are open-loop, they do not permit new engines to run at peak efficiency because the engine has to be set up to run well at 50,000 miles and beyond. U.S. Pat. No. 4,608,956 discloses such a system, even though it attempts to close the control loop around an exhaust gas sensor to correct for an air/fuel ratio that is off the target air/fuel ratio. This system cannot account for engine wear that might change the appropriate target air/fuel ratio. U.S. Pat. No. 4,825,838 uses the misfire limit as a way to close the loop using vibrations detected by an exhaust gas sensor for feedback. This system does not optimize efficiency because the misfire limit can be well beyond the air/fuel ratio for maximum efficiency. U.S. Pat. No. 4,887,575 discloses a system for determining and controlling the mixture ratio supplied to an internal combustion engine in which the air/fuel mixture ratio is estimated from the maximum internal pressure of an engine cylinder. The system of the '575 patent attempts to maintain substantially a stoichiometric mixture at all times and is merely a way of accurately estimating where that air/fuel ratio occurs.

SUMMARY OF THE INVENTION

The system according to the present invention for controlling a spark ignition engine to maximize fuel efficiency over its entire range of operating conditions includes apparatus for controlling the amount of fuel delivered to the engine and apparatus for measuring the internal cylinder pressure in at least one cylinder of the engine. Apparatus is provided for estimating the air mass entering the engine and computing apparatus calculates the engine efficiency from the amount of fuel delivered, the internal cylinder pressure and the estimated air mass entering the engine. In one embodiment, efficiency is measured by a calculation of the approximate indicated specific fuel consumption. Apparatus is provided for varying the amount of fuel delivered to the engine to minimize the indicated specific fuel consumption over the entire range of operating conditions of the engine. In a preferred embodiment, apparatus is provided which is responsive to a desired engine power output beyond wide open throttle plate and apparatus is also provided for delivering a greater quantity of fuel beyond the wide open throttle plate position minimum indicated fuel consumption point. It is preferred that the apparatus for controlling the amount of fuel delivered to the engine be a fuel injection system including a fuel atomizing device. The amount of fuel delivered to the engine may also be controlled by an externally controllable carburetor.

It is preferred that internal cylinder pressure be measured by a ring-type pressure sensor mounted around a spark plug between the spark plug and the cylinder head of the engine. Air mass entering the engine may be estimated from intake manifold pressure, intake air temperature and engine speed. Air mass entering the engine may also be estimated by a mass flow sensor in the intake stream. It is also preferred that the system include apparatus for adjusting ignition timing as a function of cylinder pressure to locate the peak pressure point at approximately 15° beyond top dead center or to maximize IMEP.

DESCRIPTION OF THE PREFERRED EMBODIMENT

The present invention is a control system for a spark ignition engine which enables an engine to achieve a substantial improvement in efficiency without sacrificing peak power. Using electronics to control the fuel injection and ignition timing, it is possible to run always at peak efficiency for all speed and load conditions. The system closes the control loop around maximum efficiency with feedback from a cylinder pressure sensor. The system operates by calculating the approximate indicated specific fuel consumption (ISFC) or brake specific fuel consumption (BSFC) and minimizes it for all speed and load conditions. In effect, the system learns what air/fuel ratios produce the maximum efficiency and uses these ratios as its target air/fuel ratio for each speed and load point. With appropriate controls, the engine can be run lean under low loads (up to the point where the throttle is wide open) after which the mixture is made richer for heavier loads by throttling in the manner of a diesel engine up to the point where a stoichiometric mixture is achieved. The present control system, combined with a high power ignition system and good fuel atomization, will raise the air/fuel ratio at which the minimum ISFC or BSFC occurs.

Figure 1:
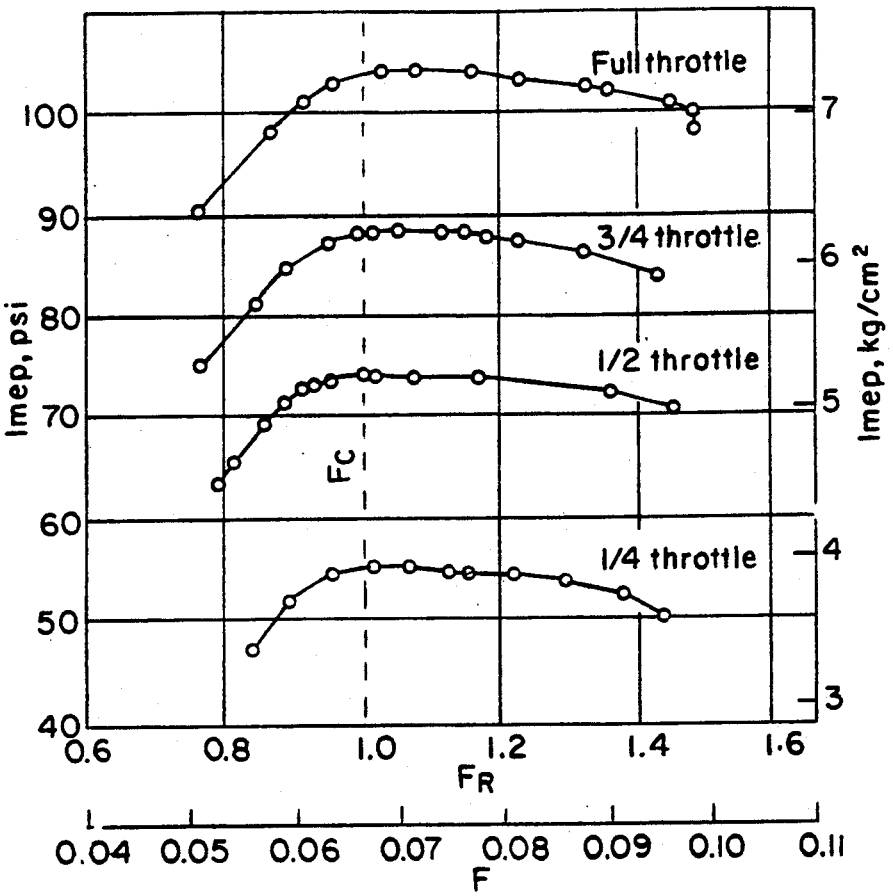
FIG. 1 is a graph of indicated mean effective pressure versus fuel/air ratio for different throttle settings.
Figure 2:
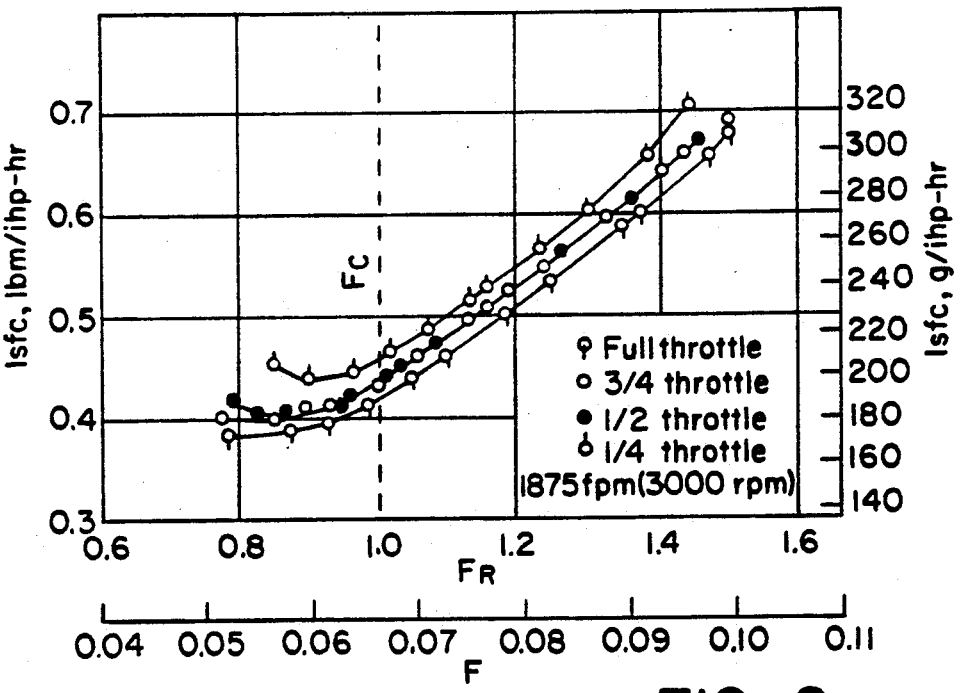
FIG. 2 is a graph of indicated specific fuel consumption versus fuel/air ratio for different throttle settings.

A brief description of engine theory will now be given so as to provide a fuller understanding of the present invention. The mean effective pressure represents the constant pressure that if applied to the piston during the expansion stroke would yield the work of the full cycle. The indicated mean effective pressure (IMEP) can be derived from this cylinder pressure. IMEP can be calculated by integrating the pressure-volume diagram. This diagram is determined by measuring the pressure in the cylinder and the rotation of the engine since its displaced volume is assumed known. IMEP is an accurate torque representation except for the amount of torque lost to internal engine friction. FIG. 1 shows the IMEP curves for different throttle settings when the air/fuel ratio is varied. With the IMEP, it is possible to calculate the indicated specific fuel consumption (ISFC). The ISFC does not take into account the internal friction of the engine but the minimum point on the curve occurs close to the same air/fuel ratio as the minimum BSFC. The minimum ISFC for a given speed and load typically occurs at a lean air/fuel ratio. FIG. 2 shows the ISFC curves of different throttle settings when the air/fuel ratio is varied. By calculating the ISFC it is possible to operate an engine very close to its maximum efficiency level at all times. The control system of the present invention will adjust the amount of fuel injected while the engine is operating until a minimum ISFC is determined for all speed and load conditions. The system will effectively learn what air/fuel ratio produces the maximum efficiency and use that as its target air/fuel ratio for each speed and load point.

Figure 3:
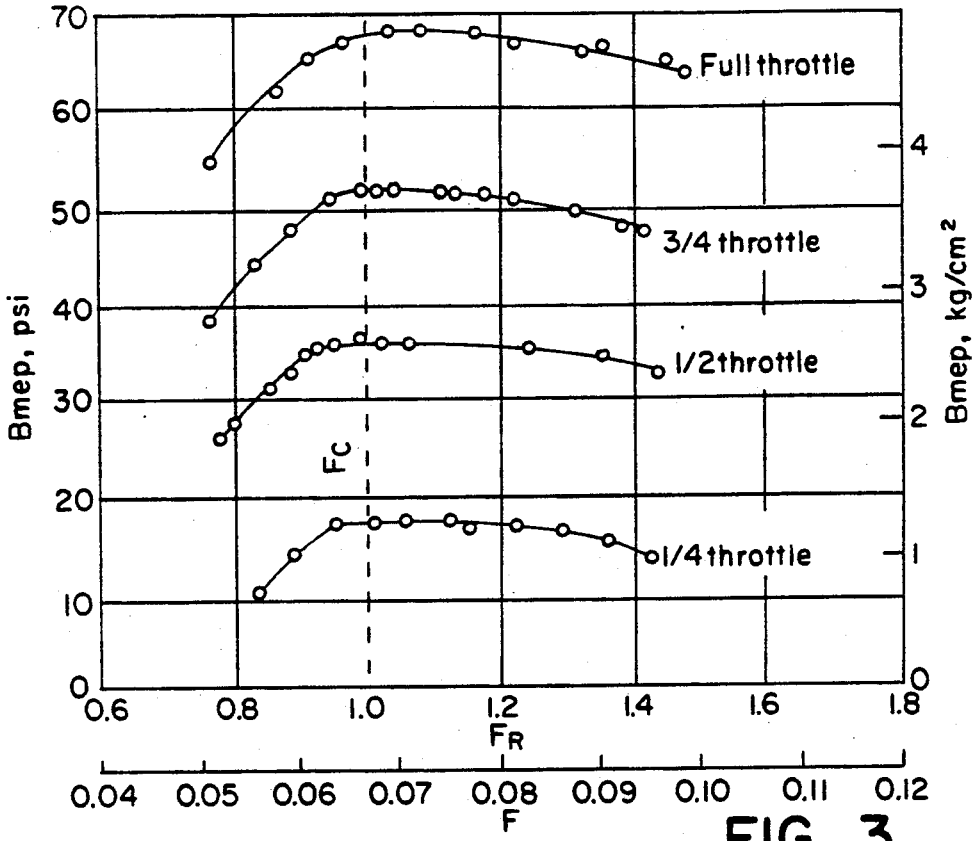
FIG. 3 is a graph of brake mean effective pressure versus fuel/air ratio for different throttle settings.
Figure 4:
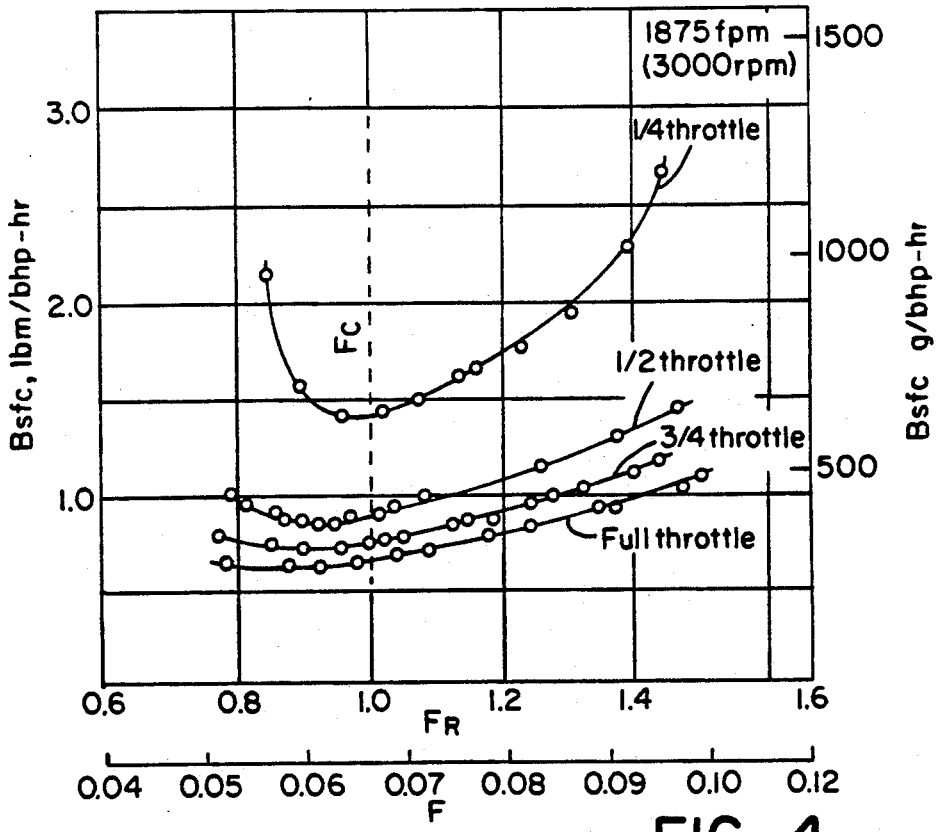
FIG. 4 is a graph of brake specific fuel consumption versus fuel/air ratio for different throttle settings.
Figure 5:
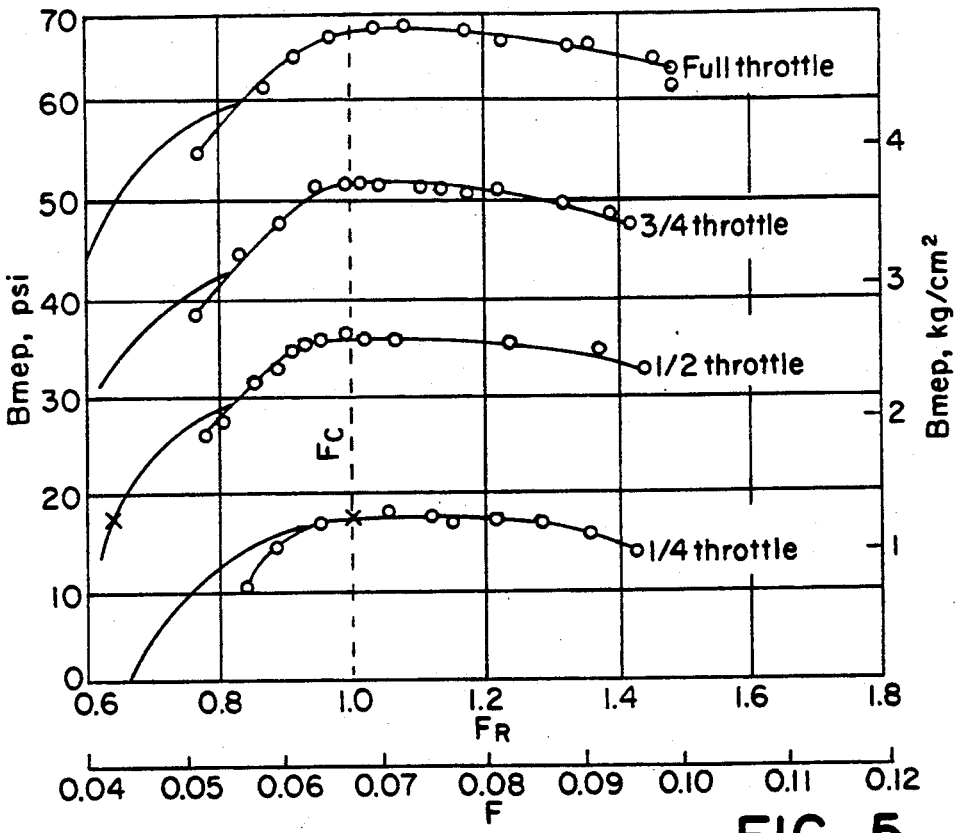
FIG. 5 is a graph of brake mean effective pressure versus fuel/air ratio for different throttle settings and extended to represent the improved operating range produced by a high power ignition system.
Figure 6:
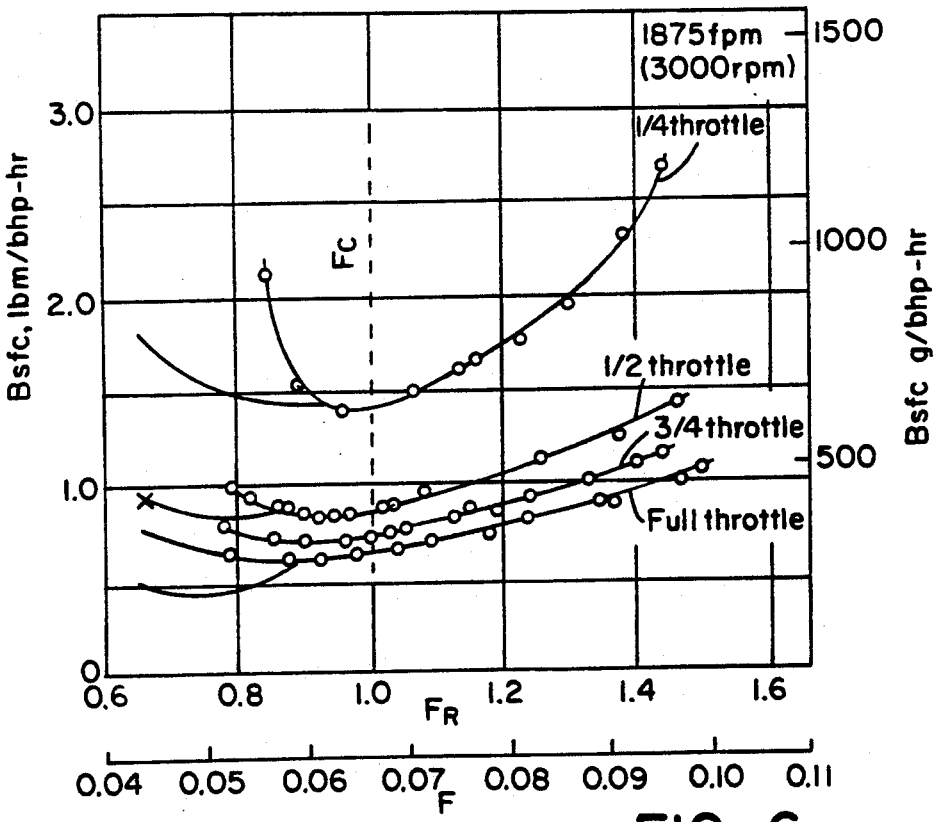
FIG. 6 is a graph of brake specific fuel consumption versus fuel/air ratio for different throttle settings and extended to represent the improved operating range produced by a high power ignition system and illustrating that the minimum occurs at a leaner air/fuel ratio.

FIG. 3 shows the BMEP curves of different throttle settings when the air/fuel ratio is varied. This figure shows that the BMEP is almost a direct reduction of the IMEP and can be derived by knowing the friction level as a function of speed and load. Engine efficiency is typically measured in brake specific fuel consumption (BSFC). A way to optimize total engine efficiency is to compare the output torque versus fuel delivered and find the point of minimum BSFC. This technique works in a laboratory where torque can be measured with a dynamometer but in a real time vehicle, torque measurement is expensive and does not give as much useful information as cylinder pressure. FIG. 4 shows the BSFC curves of different throttle settings when the air/fuel ratio is varied. Note that the minimum points of the BSFC curves have almost the same air/fuel ratio as the minimum points of the ISFC curves. The curves in the two figures, FIG. 1 and FIG. 2, correlate closely enough with the curves in FIGS. 3 and 4 that one can get approximately the same results by closing the control loop on ISFC as can be achieved with BSFC. It is also the case that BMEP can be approximated by a direct reduction of the IMEP knowing the friction level as a function of speed and load. Thus, BSFC can be calculated as a function of internal cylinder pressure, fuel mass flow and air mass flow for a known engine. These graphs were derived with a conventional ignition system. With a high power ignition, the curves in FIG. 3 will extend further down as the engine gets leaner without falling off due to misfire. As shown in FIG. 5, the extended lines represent the added operating range produced by a high power ignition system. FIG. 6 shows the corresponding extended BSFC curves where the minimum now occurs at a leaner air/fuel ratio. The extended graphs of FIGS. 5 and 6 demonstrate the efficiency gained from running leaner when one compares points of similar BMEP. With reference to FIG. 5, note that the BMEP is equal for one-half throttle lean burn versus one-quarter throttle stoichiometric air/fuel ratio. Since the BMEP is equal, power output is also the same. Relating these points to corresponding points in FIG. 6, it is possible to calculate the efficiency gained from running lean. Calculations show an approximately thirty-three percent gain for running a lean air/fuel ratio at that particular load. This increase in efficiency is greater the smaller the load is as seen in the bigger gap in efficiency between the one-fourth and one-half throttle curve as between the one-half and three-quarter throttle curve of FIG. 6. These graphs thus show that the leaner one can operate efficiently, the bigger the gain in fuel economy in light to medium load operation.

Figure 7:
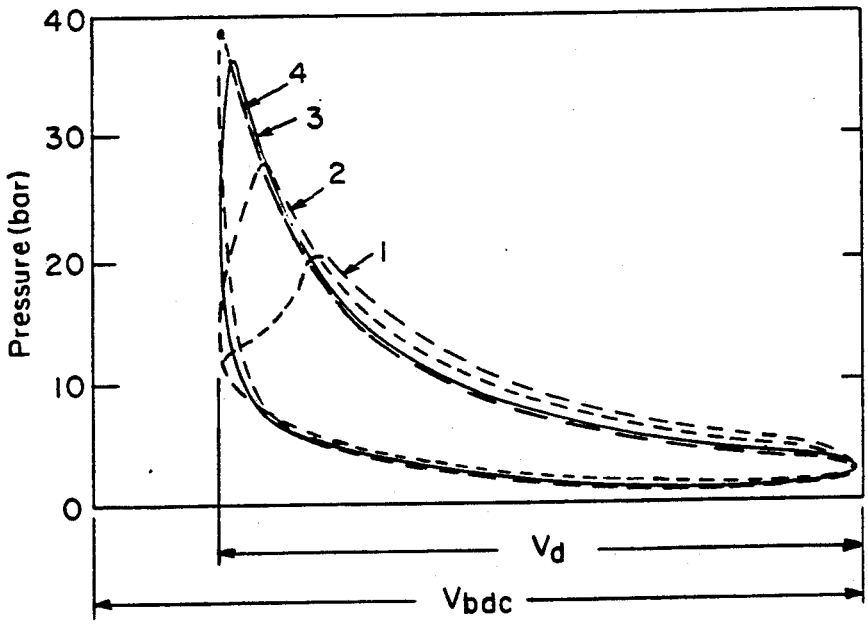
FIG. 7 is a pressure/volume diagram for different values of spark timing advance.

FIG. 7 is a pressure-volume diagram illustrating the importance of accurate spark timing advance. The timing advance can have a dramatic effect on output power and efficiency. Setting the timing advance based on the pressure curve is one important reason for having a pressure sensor rather than a torque measuring device. Thus, the control system can set proper spark timing for all speeds, loads and air/fuel ratios. Proper spark timing is critical for a variable air/fuel ratio engine because the combustion burn time changes significantly with air/fuel ratio. It is possible to set the spark timing based on either location of peak pressure or point of maximum IMEP. It has been written that setting peak pressure to about 15° past top dead center (TDC) will produce maximum efficiency, but because the system of the present invention will be running very lean, peak IMEP timing may be used.

Figure 8:
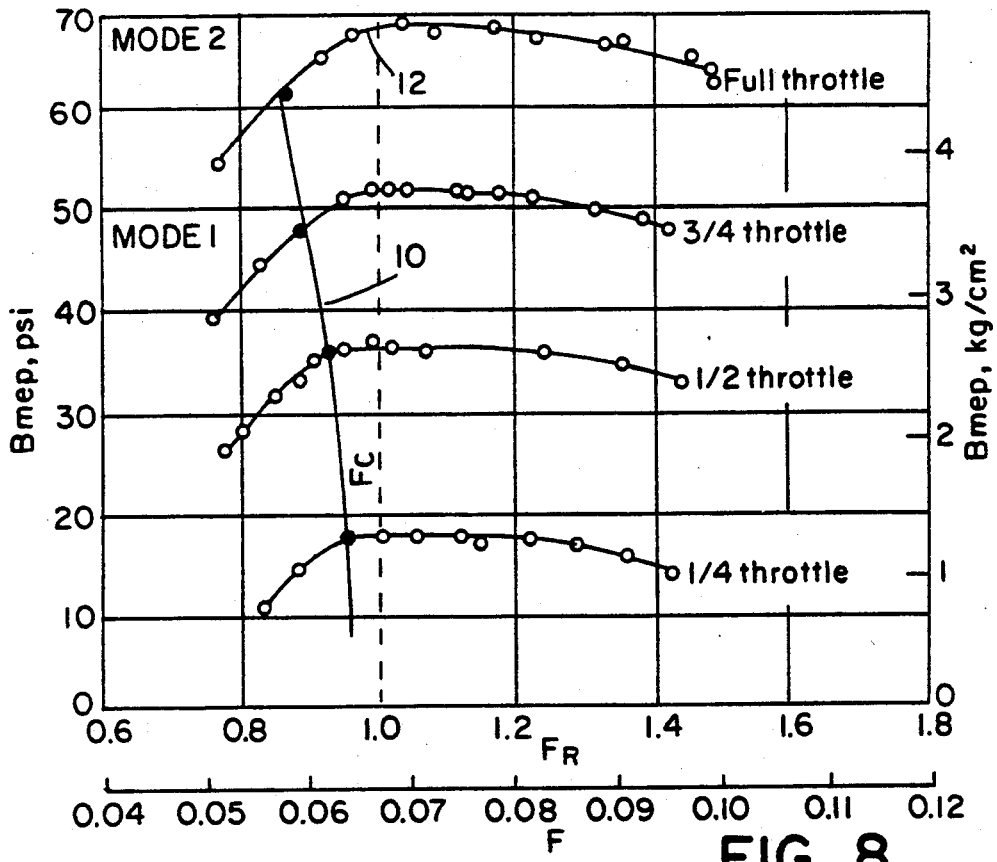
FIG. 8 is a graph of brake mean effective pressure versus fuel/air ratio showing the equivalence ratio that the control system of the present invention will follow for this particular engine.

The system of the present invention will use a dual mode of control as shown in FIG. 8. Using Otto-cyle throttling in the low to medium loads, the system will maintain an air/fuel ratio in the lean realm where IFSC or BSFC is minimum until the throttle plate is wide open. This mode is illustrated by a line 10. Above the wide open throttle point, the air/fuel ratio will be varied the way a diesel engine throttles richening the mixture until the engine reaches full load. This mode of operation is illustrated by a line 12. This dual mode operation will make it possible to achieve high fuel efficiency without sacrificing power output and also take advantage of reduced pumping losses since the throttle is always open wider than it would be in an engine operating at the stoichiometric ratio.

The air/fuel ratio control of the present invention is necessary because gasoline can only be ignited efficiently up to a specific ratio depending on the type of engine. Beyond the point of maximum efficiency, it is not beneficial to operate any leaner. The control system according to the invention can be used on stratified charge engines which create a small volume of richer mixture in which to ignite the leaner mixture. Stratified charge engines require significant redesign of the basic Otto-cycle engine. The intention of the control system of this invention is to control any spark ignition engine so as to operate at its peak efficiency at all times. While the gain in efficiency from operating lean is clear, what is unique about the present invention is that by operating at the optimum air/fuel ratio at all times, the system maximizes fuel economy. Coupling this with a dual mode throttling system, the engine will not suffer a loss of peak power. If an engine were to run in a very lean mode at all times, it would get a thirty to fifty percent reduction in power output. This lean burn power limit is shown in FIG. 8 at the top of the curve 10. If one were to compensate for that peak power loss by increasing the size of the engine, one would not benefit from the reduction in pumping losses that a smaller displacement engine would have at a point of equivalent power output. Over an average driving cycle, a dual mode engine controlled according to the invention can get a gain of twenty percent or more in fuel economy over an existing engine as compared with a lean burning engine of equivalent peak power which may get a ten percent gain.

Figure 9:
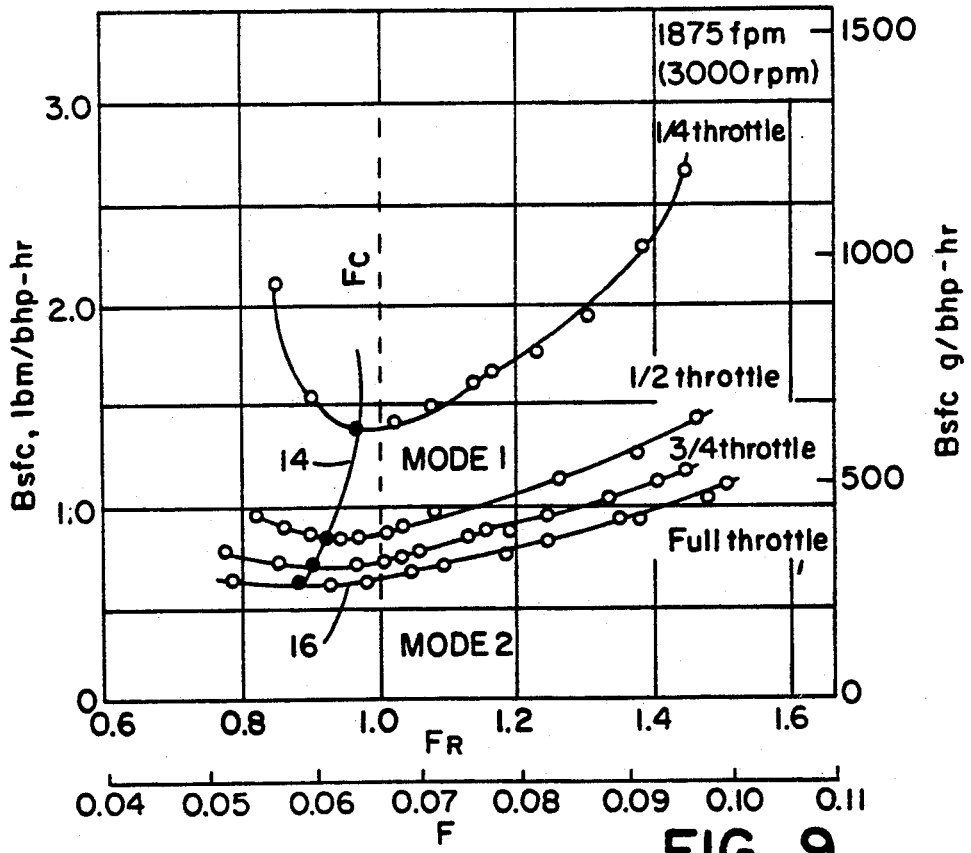
FIG. 9 is a graph of brake specific fuel consumption versus fuel/air ratio showing the equivalence ratio that the control system of the present invention will follow to achieve maximum efficiency.

FIG. 9 shows the path 14 of BSFC that the control system will follow to achieve maximum efficiency in mode 1. Mode 2 is shown by the curve 16. The fuel efficiency gain, of course, depends on the average load on the engine and its lean limit. The leaner the engine can run, the higher the efficiency gain at low to medium loads. Similarly, the lower the average load on the engine, the higher the efficiency gain will be. By maximizing the throttle opening, one minimizes pumping losses which can account for a large percentage of the wasted energy in an Otto-cycle engine. An added increase in efficiency comes from the higher level of oxygen available to combustion. Further, there is the reduction in heat input resulting in lower peak temperatures which reduce losses to the cooling system.

Figure 10:
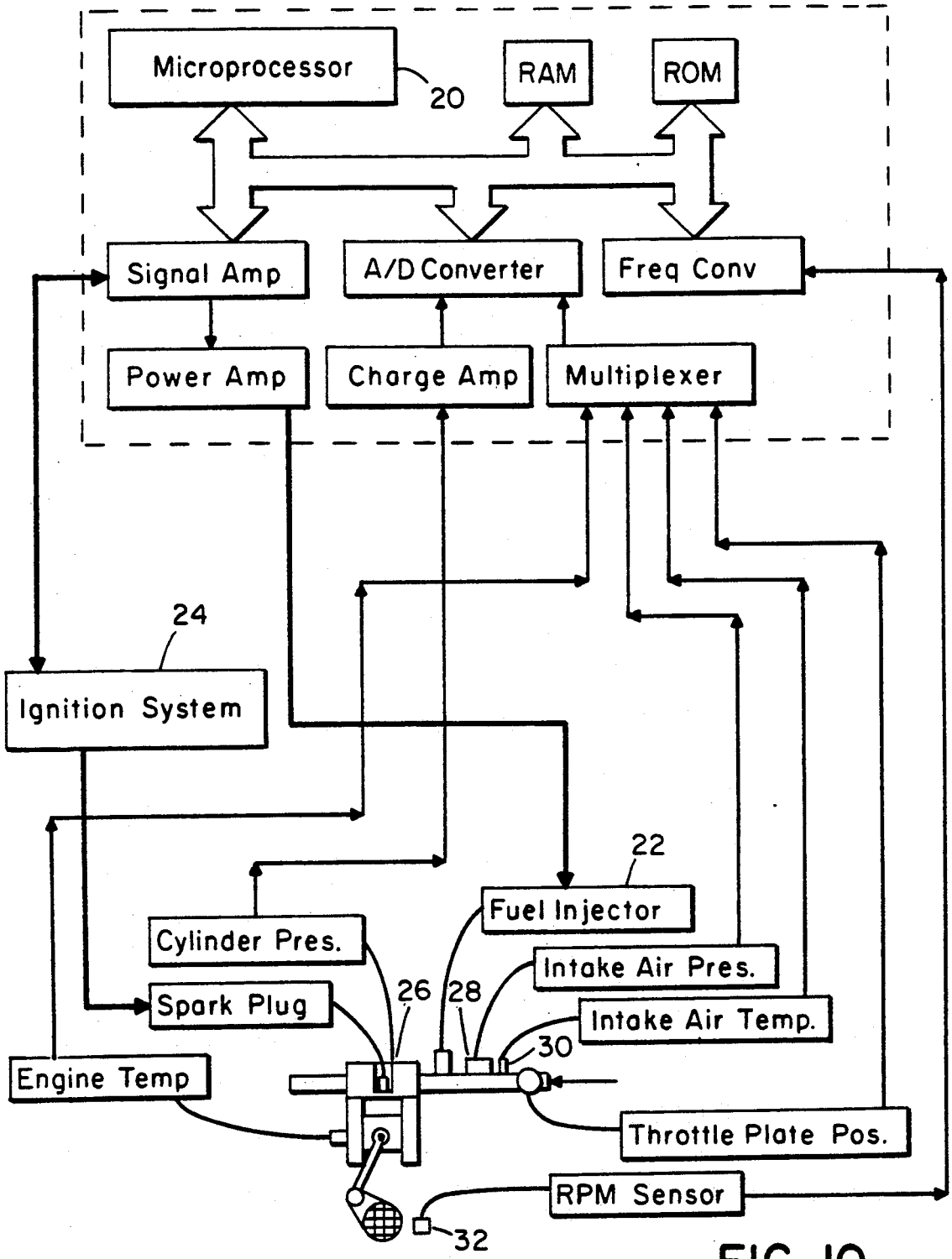
FIG. 10 is block diagram of the basic system according to the present invention to achieve control around maximum efficiency.

FIG. 10 is a block diagram of the basic system of the invention that will achieve control around maximum efficiency by learning what air/fuel ratio has the optimum fuel efficiency. This system includes a microprocessor 20 which controls the amount of fuel injected by a fuel injector 22 and also controls ignition timing by means of an ignition system 24. The microprocessor 20 responds to signals from a cylinder pressure sensor 26, an intake manifold pressure sensor 28, an intake air temperature sensor 30 and an rpm sensor 32. The microprocessor 20 calculates the air mass entering the engine based on the intake manifold pressure and intake air temperature at the present rpm. The pressure data is then analyzed to determine the amount of positive work done on the piston (IMEP). Thereafter, the microprocessor calculates the ISFC or approximate BSFC and compares that to a previously stored value.

Learning takes place when the microprocessor uses an offset air/fuel ratio and calculates a new value for efficiency. The new value will be compared to the old value in a target array and if the BSFC is lower, the new air/fuel ratio will replace the old ratio in the target array. If the new value is higher than the old, then the old value will remain and the next time the engine is in this range, the microprocessor will try an offset in the other direction. If the new value is lower than the old, then the next time the engine is in this range, the microprocessor keeps the offset in this direction. This process continues until a minimum is found, at which time the computer will smooth the data in the target array to make the transitions smoother and reduce the time it takes to get all points to their minimum BSFC.

The microprocessor will continue to try new offset values and update the target array with new numbers because as the engine wears, or things change such as engine temperature, humidity in the air and air density, they will all have an effect on the engine's efficiency. The system of the invention will automatically adjust the air/fuel ratio to the maximum efficiency point for all of these conditions. If a sensor fails, the computer will use the target array it has generated to keep running until the sensor is replaced.

In the system of the invention, pressure data from the cylinder pressure sensor 26 is used to adjust timing advance. As the engine adjusts the amount of fuel injected, the ignition timing needs to change significantly in order to keep the point of peak pressure at about 15° past top dead center (TDC). As the controller offsets from the target array, it will set a new fuel injection time, adjust timing, then calculate the new BSFC and compare it with the value stored in the target array in a manner to optimize both fuel injection time and ignition timing over the whole range of engine operation. The new timing advance will also be stored in the target array so that the system will maintain peak torque for all air/fuel ratios, even when the engine is accelerating too quickly to operate completely closed loop.

The cylinder pressure sensor 26 is critical to the operation of a lean running engine because it gives so much useful information to the controller. It is used to calculate IMEP and then ISFC and adjust timing, but it can also detect misfire and engine knocking. Having a pressure sensor is very cost effective because its presence eliminates other sensors that now provide these functions. It is also possible to use the misfire limit detected by the pressure sensor 26 to approximate the point of maximum efficiency and close the control loop. A misfire is determined when the IMEP falls below zero or by detecting irregularities in the pressure trace. This technique does not always optimize efficiency because the misfire limit can be well beyond the air/fuel ratio of maximum efficiency. It is important to be aware of misfire so that if the control system tried an offset that was too lean, engine operation can recover quickly.

A direct measure of mass flow of air is unnecessary because it can be calculated with knowledge of the intake manifold pressure, intake air temperature and rpm. This approach makes for a less expensive system but one that is less accurate as well. The lower accuracy can be compensated for with the microprocessor 20 having an air table in memory. Such a system could try to estimate air mass flow by measuring just pressure or throttle plate position, but this causes more uncertainty in the calculation of ISFC and could shift its minimum point.

The equation for mass of a perfect gas is $PV=nRT$. Mass flow of air can be estimated by $m(a)/rev=-(Pi*Vd*M)/2*R*Ti$ for a four stroke engine. In this equation, Pi equals intake manifold pressure, Vd equals displacement volume of the engine, M equals molecular weight of air, R is the universal gas constant and Ti is the temperature of the intake air. This way of calculating mass flow is not consistently accurate because it assumes the air is a perfect gas. For more accuracy, an air mass flow sensor can be used. The mass flow of fuel is calculated by m(f)=(mass flow of the injector)*(injector on time). The IMEP is calculated by integrating the pressure volume diagram. The pressure volume diagram is determined by measuring the pressure in the cylinder and the rotation of the engine since its displaced volume is known. The equation from which ISFC is calculated is $ISFC=(F/1+F)*(ev*Di/IMEP)$. In this equation, F is $\dot{m}(f)/\dot{m}(a)$, ev is volumetric efficiency, Di is density of the intake air which is equal to m(a)/Vd. ISFC is minimized in the control system if an approximation of FMEP is not available. The equation for BMEP is BMEP=IMEP−FMEP. The FMEP is an experimentally derived value that is stored in memory as an equation based on speed and load. The equation for calculating BSFC is $BSFC=(F/1+F)*(ev*Di/BMEP)$. BSFC is minimized in the control system if an approximation of FMEP is available.

By having the important cylinder pressure information available, one can optimize efficiency under any condition. By using a simple system, the computing power required is increased but the system becomes more cost effective.

It is noted that all of the hardware subsystems used in the present invention exist today. As to software, those skilled in the art will readily be able to design software to implement the system of the invention. Further, the method of the present invention can be used on any spark ignition engine regardless of type. The system will optimize efficiency by setting proper air/fuel ratios and accurate spark timing for all load levels of the engine.

Figure 11:
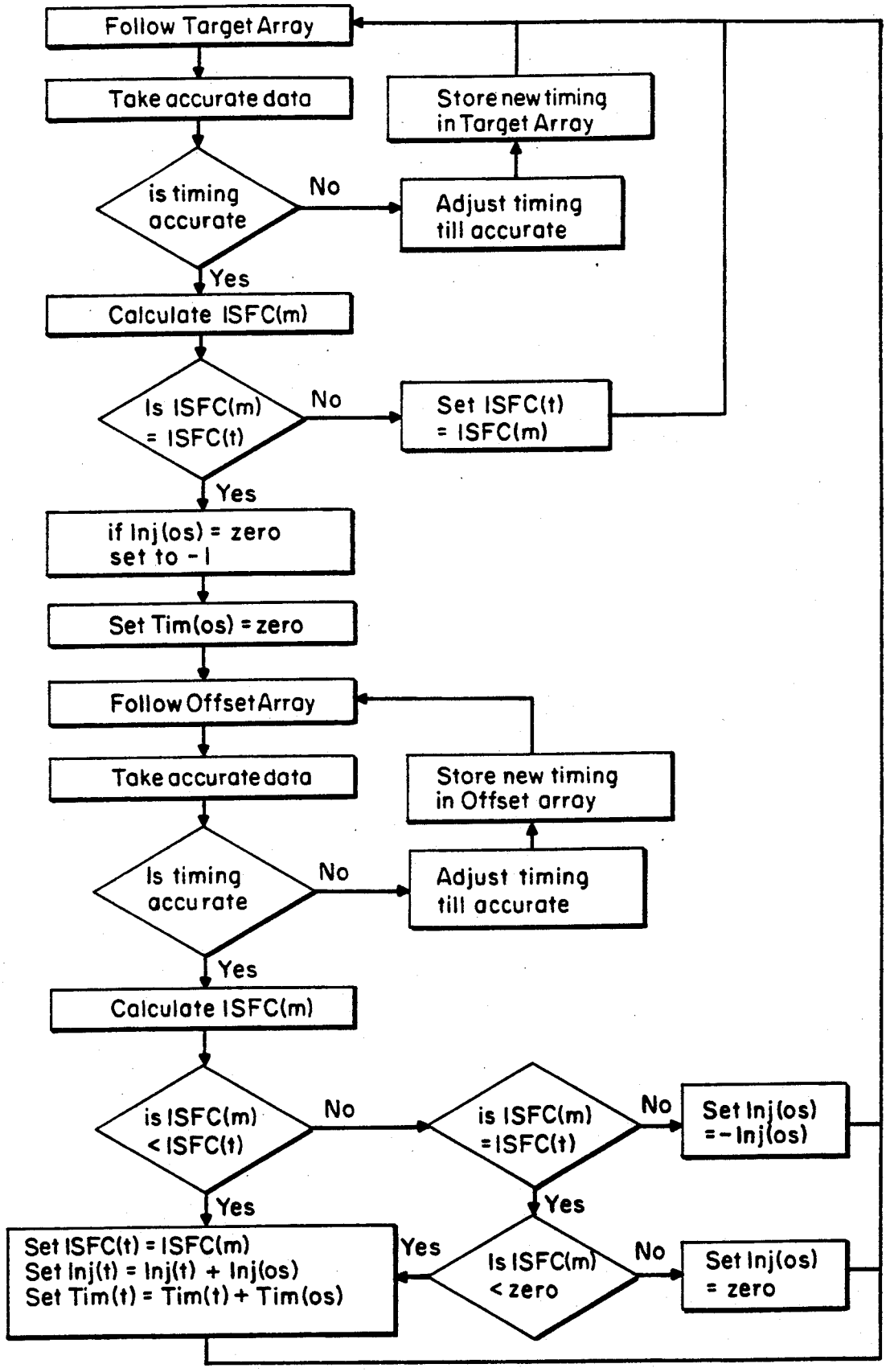
FIG. 11 is a control flow chart that a microprocessor will use to optimize air/fuel ratio by minimizing indicated specific fuel consumption or brake specific fuel consumption.

The control optimization will be performed according to the flow chart shown in FIG. 11. As shown in FIG. 11, the procedure is as follows:

1. Follow the target array for injection time and ignition timing. Take data long enough to be confident of accuracy.
2. Check if timing is accurate. If it is accurate, proceed to step 3 below. If timing is not accurate, change timing until it is accurate and store the correct timing in the target array and return to step 1.
3. Calculate ISFC (measured).
4. Compare ISFC (measured) with ISFC (target). If they are equal, proceed to step 5 below. If they are not equal, replace ISFC (target) with ISFC (measured) in the target array and go back to step 1.
5. Check injection offset value. If it is zero, set it to −1.
6. Follow the target array with offset values for injection time and ignition timing. Take data long enough to be confident of the accuracy.
7. Check if timing is accurate. If it is, proceed to step 8 below. If it is not, change it until it is accurate and store the correct timing offset in the offset array, then go back to step 6.
8. Calculate ISFC (measured) based on the data.
9. If ISFC (measured) is less then ISFC (target), add the offset values to the values in the target array and replace the old values of injection time, ignition timing and ISFC with the new values, then go back to step 1. Otherwise, go to step 10.
10. If ISFC (measured) is equal to ISFC (target) and the injection time offset was negative, add the offset values to the values in the target array and replace the old values of injection time, ignition timing and ISFC with the new values; then go back to step 1. Otherwise, go to step 11.
11. If ISFC (measured) is equal to ISFC (target) and the injection time offset was positive, change offset value to zero, then go back to step 1. Otherwise, go to step 12.
12. If ISFC (measured) is greater than ISFC (target), change the sign of the offset value and go back to step 1.

If the system gets stuck in the same loop ten times, it will either go back to the beginning or continue on by averaging the ten cycles and using the average values on which to base further decisions.

In the above, the following definitions are used:

OFFSET: The injection time offset will be a percentage of the total injection time for that point in the target array. One percent has been used as an example but this value can vary depending on the accuracy required and the rate of change in the engine at the particular time. The ignition timing offset is the amount of degrees of change in ignition advance from the target ignition timing that is required to achieve accurate timing.

ACCURATE TIMING: This occurs when the spark advance is set so that peak cylinder pressure occurs at about 15° past top dead center.

EQUAL: Equal means close enough to be able to make valid changes in control parameters. It may also mean equal within a predetermined percentage either side of the value used for comparison.

CONFIDENCE IN DATA: This expression means data is taken for at least two engine cycles and the data values are equal or the data values are averaged over enough cycles to be valid. In the array, the computer will store injection time, ISFC, and ignition timing.

In order to achieve full power, a throttle input device will measure the throttle plate position until the point of wide open throttle. Then it will allow further pedal input to indicate a request for more power and the controller of the invention will gradually increase the fuel delivered until a stoichiometric air/fuel ratio is reached.

Figure 12:
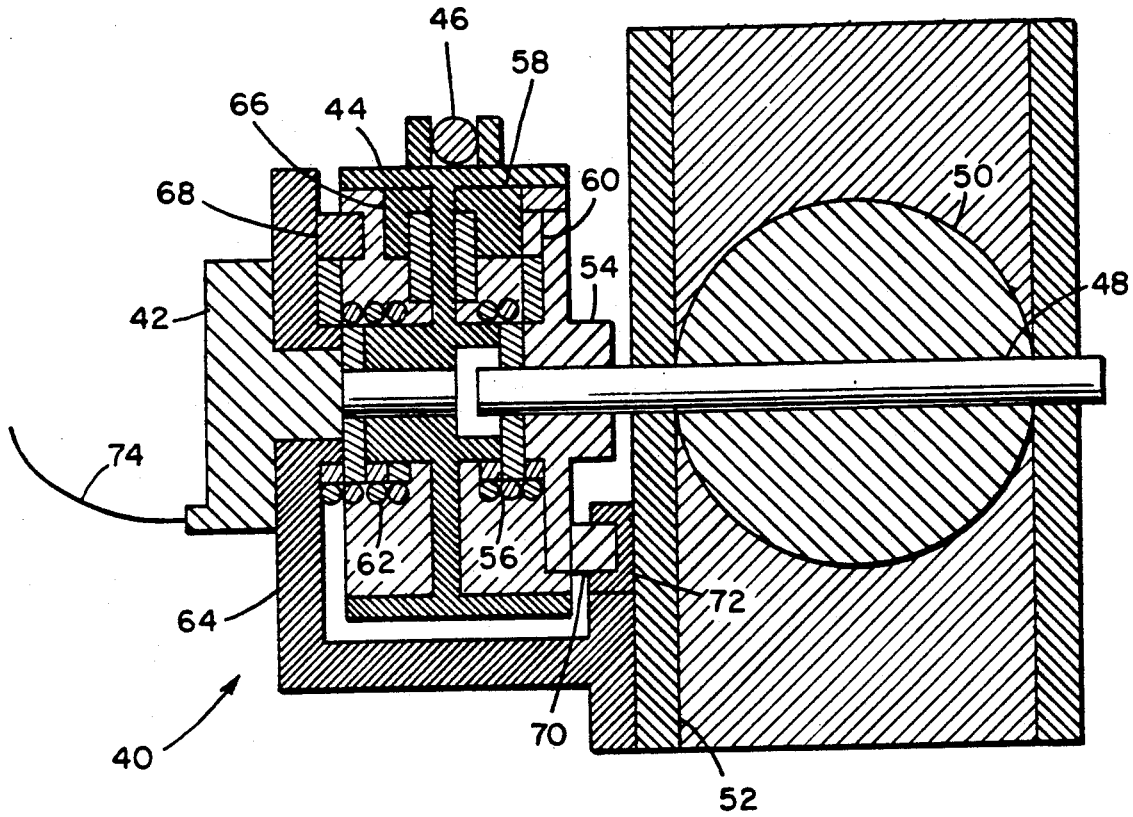
FIG. 12 is a cross-sectional view of a throttle plate and pedal position sensor to provide an input signal to the controller of the invention for dual mode operation.

FIG. 12 shows a device that can provide an input signal to the controller for dual mode operation. A throttle input device 40 includes a potentiometer 42 that changes resistance as a function of rotation of its shaft. The shaft of the potentiometer 42 rotates with a disk 44 which is turned by a throttle cable 46. A throttle plate shaft 48 supports a throttle plate 50 for rotation in an intake manifold 52. The shaft 48 is affixed to a disk 54 which rotates with the disk 44 until the throttle plate 50 is wide open, that is, when the throttle plate 50 is vertical. As the disk 44 rotates farther, the throttle plate 50 remains in its wide open position while disk 44 will continue to rotate the shaft of the potentiometer 42. A spring 56 operates between disks 44 and 54 to put a force on tab 58 on disk 44 and tab 60 on disk 54, forcing the two tabs together. A spring 62 operates between the disk 44 and the base 64 of the device 40 that applies a force on tab 66 on disk 44 and on tab 68 mounted on the base 64 which holds the throttle plate 50 closed against the force of the throttle cable 46.

The throttle input device 40 works by measuring the rotation of the disk 44 which is a direct function of throttle pedal position through throttle cable 46, assuming that the force of spring 62 is sufficient to overcome all friction forces acting on a throttle pedal (not shown). As the throttle pedal is depressed, thereby activating throttle cable 46, the disk 44 will rotate with the disk 54 assuming that the force of spring 56 is sufficient to overcome all friction forces and air pressure acting on the throttle plate 50. The disks 44 and 54 will rotate together until a tab 70 on the disk 54 makes contact with a tab 72 on the intake manifold section 52. Tab 70 makes contact with tab 52 at wide open throttle when throttle plate 50 is vertical. Thereafter, the disk 44 can continue to rotate further against the force of both springs 56 and 62 continuing to rotate the potentiometer 42 farther. The microprocessor 20 (FIG. 10) is connected to the throttle input device 40 by means of a wire 74 and the microprocessor 20 is presumed to know the resistance value of the potentiameter 42 at the point that the tab 70 makes contact with the tab 72 at which time the throttling mode is switched so as to operate in mode 2 throttling.

Otto-diesel throttling control will increase the engine's power output over a lean burn engine of equivalent displacement and increase fuel economy relative to a lean burn engine of equivalent output. The throttle position sensor will also help give a more accurate mass flow calculation but is more important for allowing a reversion to a richer air/fuel ratio beyond wide open throttle.

Figure 13:
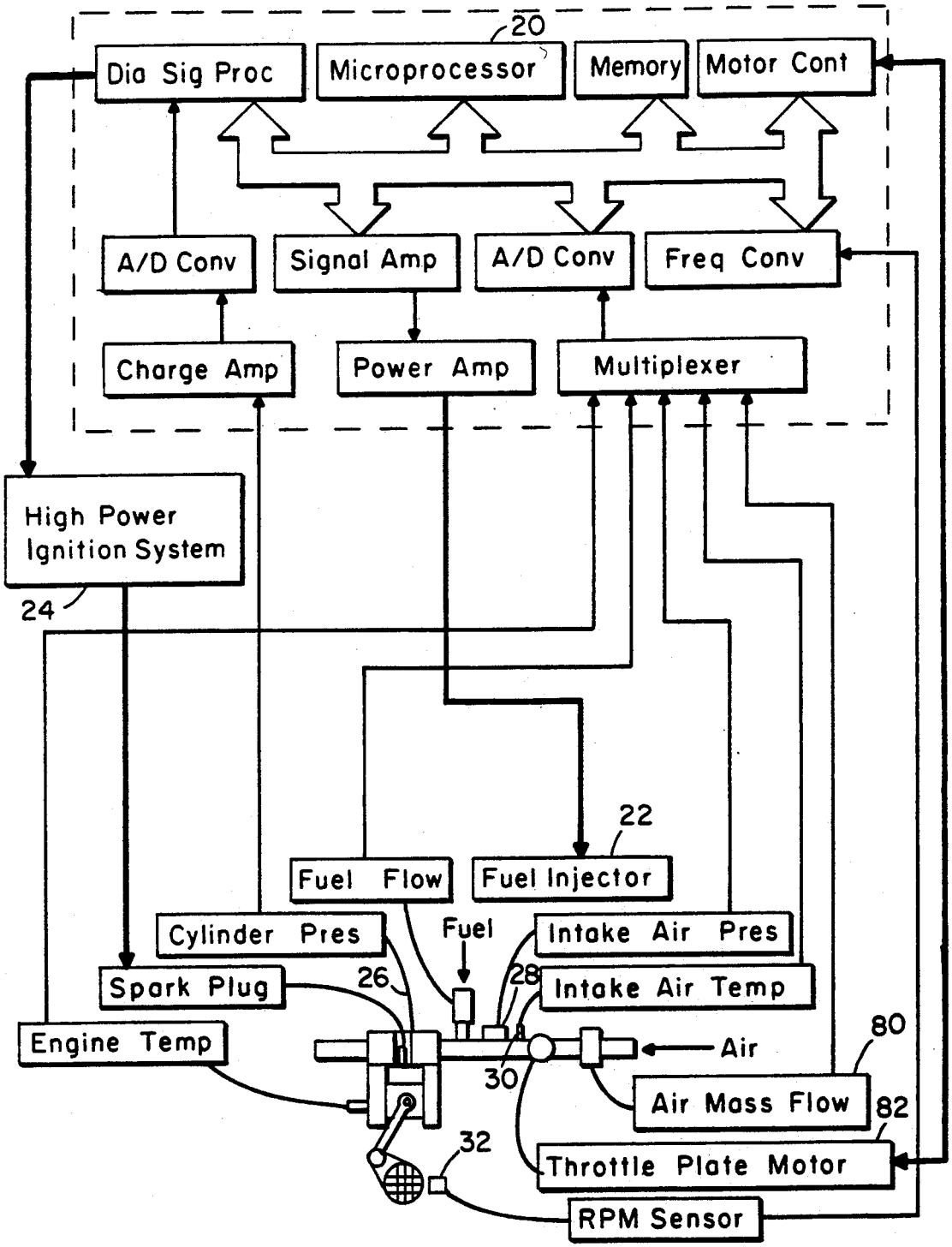
FIG. 13 is a block diagram of a complete engine control system according to the invention for more accurate control around maximum efficiency.

FIG. 13 shows the complete system according to the invention that will achieve more accurate control around maximum efficiency by controlling the throttle plate and directly measuring air mass flow by means of an air mass flow sensor 80. There are many ways to optimize the fuel efficiency on an engine. The most effective way is to put microprocessor 20 in control of fuel injection 22, ignition timing by means of a high power ignition system 24 and throttle plates by means of a throttle plate motor 82 with the cylinder pressure sensor 26 feeding information back so that efficiency is optimized. The microprocessor 20 will also monitor throttle pedal input, engine temperature, intake pressure, air mass flow and rpm. With control of the throttle plates, the microprocessor 20 can optimize engine efficiency without having any change in drivability. The throttle pedal input will simply represent an rpm target or IMEP level that the computer should achieve. This manner of control will allow the microprocessor 20 to control the fuel injection 22 to deliver a full rich mixture to be used under hard acceleration and a lean mixture when the engine is at low loads. The system of the invention will also allow the control algorithm to avoid any air/fuel ratio that may cause excess emissions or have destructive effects on the engine.

The present control system will automatically optimize for greatest efficiency by minimizing ISFC or BSFC. The engine's lean limit will be monitored by the pressure sensor 26 which will sense the point at which IMEP falls below zero. In this way, the engine can be operated lean without misfiring. The pressure sensor 26 can also be used to detect knock and to adjust timing to prevent knock should it occur. Further improvements can be made with better fuel atomization and a high power ignition system. A gain can also be achieved by increasing the compression ratio, because a lean mixture burns slower, preventing knock even at higher compression. These refinements are necessary for lowering total emissions output and improve efficiency as well.

Figure 14:
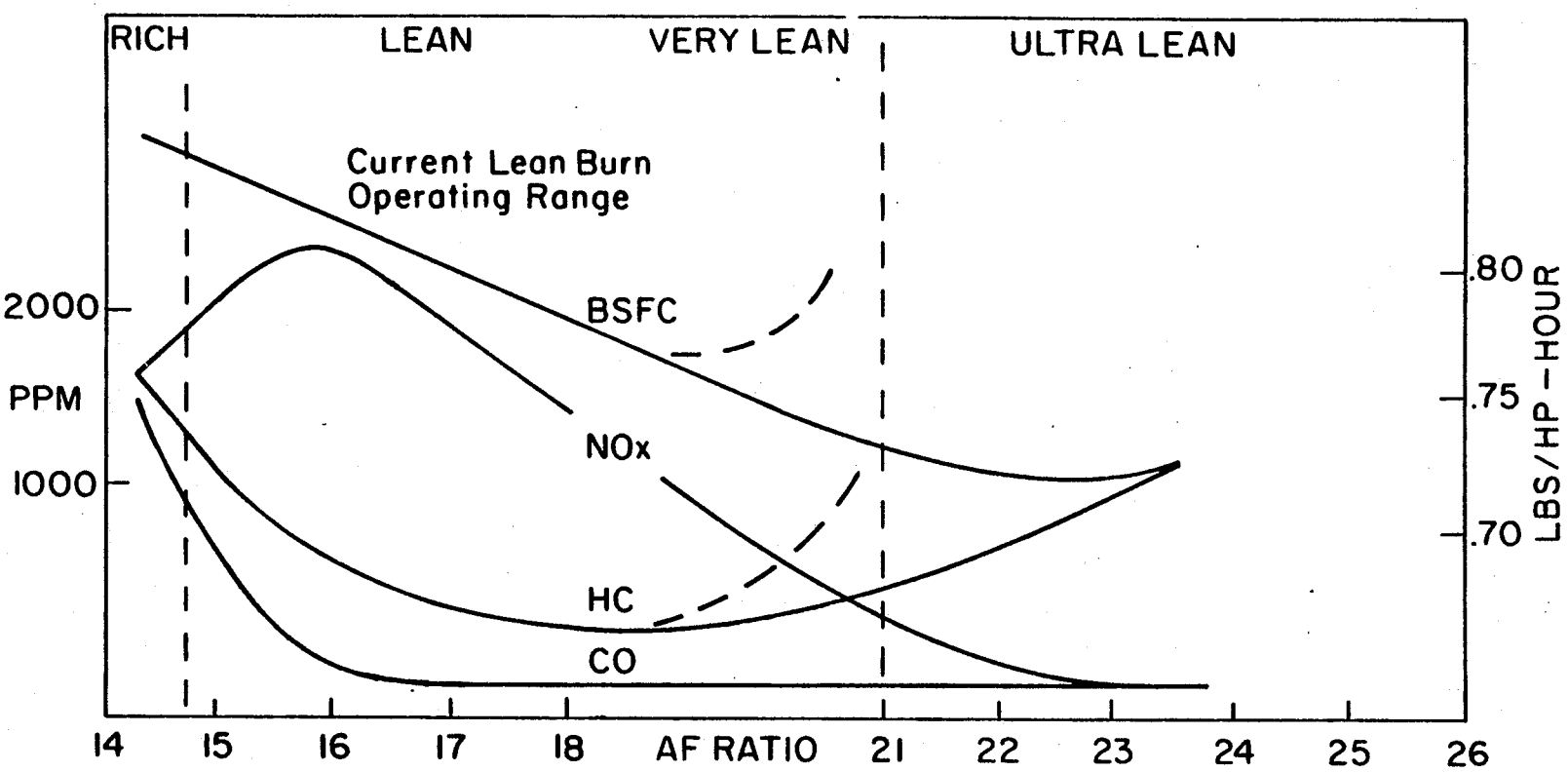
FIG. 14 is a graph of emissions versus air/fuel ratio illustrating improved operating range produced by a high power ignition system.

FIG. 14 shows emissions curves representing improved operating range resulting from a high power ignition system, illustrating that emissions are lower at leaner air/fuel ratios. With a high power ignition system and better fuel atomization, the present control system will increase the leaness of the optimum air/fuel ratio achieving a reduction of emissions as shown by the curves in FIG. 14. The reason for extending the lean operating point is to get over the hump in emissions of oxides of nitrogen in the lean range just above the stoichiometric air/fuel ratio. Running an engine leaner than stoichiometric will lower the total emissions until the engine passes the point of minimum BSFC or maximum efficiency. This is the case since when the engine is running at its maximum efficiency air/fuel ratio, the conversion of fuel energy to mechanical energy is the most nearly complete. Running an engine leaner than this point will cause it to encounter worse combustion and eventually to misfire. The present invention maintains the engine operating in the range of maximum efficiency and minimum emissions.

Figure 15:
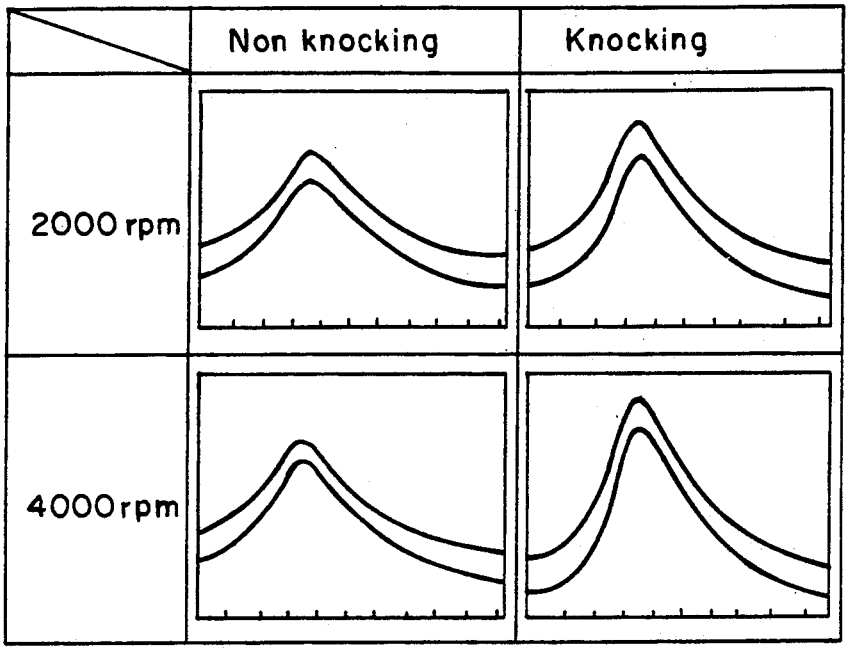
FIG. 15 includes graphs of pressure versus time of two types of pressure transducers detecting knock.
Figure 15:
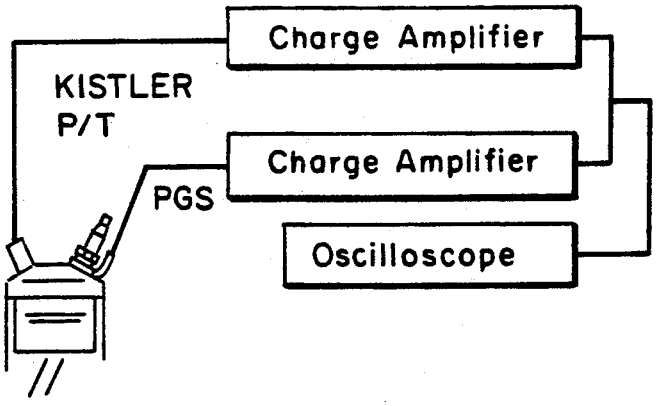

FIG. 15 shows pressure traces from two types of pressure transducers detecting knock. As will be appreciated by those skilled in the art, the control of ignition timing needs to respond to engine detonation. Such control can be achieved by monitoring the smoothness of the pressure wave. When an engine knocks, the pressure wave oscillates wildly around top dead center, responding to the shock wave detonation.

It is recognized that modifications and variations in the control system disclosed herein will occur to those skilled in the art. It is intended that all such modifications and variations be included within the scope of the appended claims.

What is claimed is:

1. A system for controlling a spark ignition engine to maximize fuel efficiency over its entire range of operating conditions comprising:

apparatus for controlling the amount of fuel delivered to the engine;

apparatus for measuring the internal cylinder pressure in at least one cylinder of the engine;

apparatus for estimating the air mass entering the engine;

apparatus for calculating the approximate efficiency of the engine represented by the indicated specific fuel consumption or the approximate brake specific fuel consumption from the amount of fuel delivered, the internal cylinder pressure and the estimated air mass entering the engine; and apparatus for varying the amount of fuel delivered to the engine to maximize efficiency over the entire range of operating conditions of the engine by minimizing the indicated specific fuel consumption or the approximate brake specific fuel consumption.

2. The system of claim 1 further including:

apparatus responsive to a desired engine power output beyond wide open throttle plate; and apparatus for delivering a greater quantity of fuel beyond the wide open throttle plate position maximum efficiency point.

3. The system of claim 1 wherein the apparatus for controlling the amount of fuel delivered to the engine comprises a fuel injection system.

4. The system of claim 3 wherein the fuel injection system includes a fuel atomizing device.

5. The system of claim 1 wherein the apparatus for controlling the amount of fuel delivered to the engine comprises an externally controllable carburetor.

6. The system of claim 1 wherein the apparatus for measuring the internal cylinder pressure comprises a ring-type pressure sensor mounted around a spark plug between the spark plug and the cylinder head of the engine.

7. The system of claim 1 wherein the apparatus for estimating the air mass entering the engine comprises an intake manifold pressure sensor, an intake air temperature sensor, and means for determining engine speed.

8. The system of claim 1 wherein the apparatus for estimating the air mass entering the engine comprises a mass flow sensor in the intake stream.

9. The system of claim 1 further including apparatus for adjusting ignition timing as a function of cylinder pressure to locate the peak pressure point at approximately 15° after top dead center or to maximize IMEP.

10. The system of claim 1 wherein fuel mass flow is calculated by $m_f = m_f$ of injector/Duration of injection.

11. The system of claim 1 further including a fuel mass flow sensor.

12. The system of claim 1 wherein the approximate efficiency is calculated by:

1) following a target array for injection time and ignition timing and taking data for a period long enough to be confident of accuracy;
2) checking if timing is accurate; if accurate, proceeding to step 3 below; if timing is not accurate, changing timing until it is accurate and storing the correct timing in the target array and returning to step 1 above;
3) calculating ISFC (measured) based on the data;
4) comparing ISFC (measured) with an ISFC (target); if they are equal, proceeding to step 5 below; if they are not equal, replacing ISFC (target) with ISFC (measured) in the target array and going back to step 1 above;
5) checking injection offset value; if it is zero, setting it to minus 1;
6) following the target array with offset values for injection time and ignition timing; taking data long enough to be confident of accuracy;
7) checking if timing is accurate; if it is accurate, proceeding to step 8 below; if it is not accurate, changing it until it is accurate and storing the correct timing offset in the offset array; then going back to step 6 above;
8) calculating ISFC (measured) based on the data;
9) if ISFC (measured) is less than ISFC (target), adding the offset values to the values in the target array and replacing the old values of injection time, ignition timing, and ISFC with the new values; then going back to step 1 above; or otherwise going to step 10 below.
10) if ISFC (measured) is equal to ISFC (target) and the injection time offset was negative, adding the offset values to the values in the target array and replacing the old values of injection time, ignition timing and ISFC with the new values; then going back to step 1; or otherwise going to step 11 below;
11) if ISFC (measured) is equal to ISFC (target) and the injection time offset was positive, changing offset value to zero; then going back to step 1; or otherwise going to step 12 below;
12) if ISFC (measured) is greater than ISFC (target), changing the sign of the offset value and going back to step 1 above.

13. The system of claim 1 wherein the approximate efficiency is calculated by:

1) following a target array for injection time and ignition timing and taking data for a period long enough to be confident of accuracy;
2) checking if timing is accurate; if accurate, proceeding to step 3 below; if timing is not accurate, changing timing until it is accurate and storing the correct timing in the target array and returning to step 1 above;
3) calculating BSFC (measured) based on the data;
4) comparing BSFC (measured) with an BSFC (target); if they are equal, proceeding to step 5 below; if they are not equal, replacing BSFC (target) with BSFC (measured) in the target array and going back to step 1 above;
5) checking injection offset value; if it is zero, setting it to minus 1;

6) following the target array with offset values for injection time and ignition timing; taking data long enough to be confident of accuracy;
7) checking if timing is accurate; if it is accurate, proceeding to step 8 below; if it is not accurate, changing it until it is accurate and storing the correct timing offset in the offset array; then going back to step 6 above;
8) calculating BSFC (measured) based on the data;
9) if BSFC (measured) is less than BSFC (target), adding the offset values to the values in the target array and replacing the old values of injection time, ignition timing, and BSFC with the new values; then going back to step 1 above; or otherwise going to step 10 below.
10) if BSFC (measured) is equal to BSFC (target) and the injection time offset was negative, adding the offset values to the values in the target array and replacing the old values of injection time, ignition timing and BSFC with the new values; then going back to step 1; or otherwise going to step 11 below;
11) if BSFC (measured) is equal to BSFC (target) and the injection time offset was positive, changing offset value to zero; then going back to step 1; or otherwise going to step 12 below;
12) if BSFC (measured) is greater than BSFC (target), changing the sign of the offset value and going back to step 1 above.

14. The system of claim 1 wherein the indicated specific fuel consumption is computed by the equation $$ISFC = \left(\frac{F}{1+F}\right) * (e_v * Di/IMEP)$$

where $e_v$ is volumetric efficiency of the engine and $F = \dot{m}_f/\dot{m}_a$, and Di is density of intake air.

15. The system of claim 1 wherein the brake specific fuel consumption is computed by the equation $$BSFC = \left(\frac{F}{1+F}\right) * \left(\frac{e_v Pi}{BMEP}\right).$$

16. The system of claim 7 wherein air mass is calculated for a four stroke engine by the equation m(a)/-rev=(Pi*Vd*M)/2*R*Ti where m(a) is the mass of air, Pi is intake manifold pressure, Vd is the displacement volume of the engine, M is the molecular weight of air, R is the universal gas constant and Ti is intake air temperature.

17. The system of claim 16 wherein the air mass calculation is performed by a microprocessor.

18. The system of claim 2 including a potentiometer for measuring throttle pedal position up to and beyond wide open throttle plate position, the output of the potentiometer serving as an input to the apparatus for delivering the optimum quantity of fuel.

19. The system of claim 2 further including a microprocessor to control throttle plate position in response to a throttle pedal position input.

20. The system of claim 18 wherein the potentiometer is connected to a first disk arranged to rotate a shaft of the potentiometer, the first disk also connected to a throttle pedal cable;

a second disk arranged to rotate a throttle plate from a closed to a wide open position; and apparatus to constrain the first and second disks to rotate together until the throttle plate reaches the wide open position, and to allow the first disk alone to continue to rotate thereafter.

21. The system of claim 1 or claim 4 further including a high power ignition system.

* * * * *